US009865390B2

(12) United States Patent
Li et al.

(10) Patent No.: US 9,865,390 B2
(45) Date of Patent: Jan. 9, 2018

(54) COIL COMPONENT AND POWER SUPPLY APPARATUS INCLUDING THE SAME

(71) Applicant: Solum Co., Ltd., Suwon-si (KR)

(72) Inventors: Xin Lan Li, Suwon-si (KR); Jae Gen Eom, Suwon-si (KR); Geun Young Park, Suwon-si (KR); Se Hoon Jang, Suwon-si (KR); Heung Gyoon Choi, Suwon-si (KR)

(73) Assignee: Solum Co., Ltd., Suwon-si (KR)

( * ) Notice: Subject to any disclaimer, the term of this patent is extended or adjusted under 35 U.S.C. 154(b) by 0 days.

(21) Appl. No.: 15/358,999

(22) Filed: Nov. 22, 2016

(65) Prior Publication Data

US 2017/0076856 A1 Mar. 16, 2017

Related U.S. Application Data

(63) Continuation of application No. 14/634,183, filed on Feb. 27, 2015, now Pat. No. 9,536,651.

(30) Foreign Application Priority Data

Sep. 11, 2014 (KR) ..... 10-2014-0120463
Oct. 10, 2014 (KR) ..... 10-2014-0136632

(51) Int. Cl.
*H01F 5/00* (2006.01)
*H01F 27/28* (2006.01)
(Continued)

(52) U.S. Cl.
CPC ..... *H01F 27/324* (2013.01); *H01F 27/263* (2013.01); *H01F 27/2804* (2013.01);
(Continued)

(58) Field of Classification Search
CPC ..... H01F 27/32
(Continued)

(56) References Cited

U.S. PATENT DOCUMENTS 5,684,445 A * 11/1997 Kobayashi ..... H01F 27/2866 336/206
6,529,389 B2 * 3/2003 Perlick ..... H01F 27/06 363/142
(Continued)

FOREIGN PATENT DOCUMENTS

CN 1383569 A 12/2002
CN 1488152 A 4/2004
(Continued)

OTHER PUBLICATIONS

Chinese Office Action dated Jun. 8, 2017 in counterpart Chinese Patent Application No. 201510138168.3 (24 pages, in Chinese with English translation).

*Primary Examiner* — Ronald Hinson
(74) *Attorney, Agent, or Firm* — NSIP Law

(57) ABSTRACT

A coil component includes a first coil part including a multilayer substrate on which a conductor pattern is formed, a second coil part formed as a wire and stacked together with the first coil part, a core coupled to the first and second coil parts while penetrating through the first and second coil parts to thereby be electromagnetically coupled to the first and second coil parts, and a pressing member interposed between the core and the second coil part to allow the first and second coil parts to closely adhere to each other.

8 Claims, 6 Drawing Sheets

(51) Int. Cl.
*H01F 27/32* (2006.01)
*H01F 27/26* (2006.01)
*H01F 27/29* (2006.01)

(52) U.S. Cl.
CPC ..... *H01F 27/2823* (2013.01); *H01F 27/292* (2013.01); *H01F 2027/2809* (2013.01); *H01F 2027/2814* (2013.01)

(58) Field of Classification Search
USPC ..... 336/200
See application file for complete search history.

(56) References Cited

U.S. PATENT DOCUMENTS

| | | | | |
|---|---|---|---|---|
| 6,628,531 | B2 | 9/2003 | Dadafshar | |
| 7,714,687 | B2 * | 5/2010 | Marui | H01F 5/02 336/131 |
| 7,948,344 | B2 | 5/2011 | Kaneko | |
| 8,947,190 | B2 | 2/2015 | Park | |
| 9,401,243 | B2 | 7/2016 | Park | |
| 2002/0070834 | A1 | 6/2002 | Dadafshar | |
| 2002/0075120 | A1 * | 6/2002 | Yeh | H01F 27/2804 336/223 |
| 2002/0159214 | A1 | 10/2002 | Perlick et al. | |
| 2010/0039204 | A1 | 2/2010 | Kaneko | |
| 2010/0277267 | A1 | 11/2010 | Bogert et al. | |
| 2012/0002387 | A1 | 1/2012 | Park et al. | |
| 2013/0099885 | A1 | 4/2013 | Park | |
| 2015/0102883 | A1 | 4/2015 | Park | |

FOREIGN PATENT DOCUMENTS

| | | | |
|---|---|---|---|
| CN | 101651025 | A | 2/2010 |
| CN | 102428528 | A | 4/2012 |
| CN | 103081044 | A | 5/2013 |
| JP | 3427428 | B2 | 5/2003 |
| JP | 2012-15525 | A | 1/2012 |
| KR | 20-2010-0008319 | U | 8/2010 |
| KR | 10-2011-0066792 | A | 6/2011 |
| KR | 10-2014-0004847 | A | 1/2014 |

* cited by examiner

COIL COMPONENT AND POWER SUPPLY APPARATUS INCLUDING THE SAME

CROSS-REFERENCE TO RELATED APPLICATIONS

This application is a Continuation of U.S. application Ser. No. 14/634,183 filed on Feb. 27, 2015, which claims the priority and benefit of Korean Patent Application No. 10-2014-0120463 filed on Sep. 11, 2014, and Korean Patent Application No. 10-2014-0136632 filed on Oct. 10, 2014, with the Korean Intellectual Property Office, the disclosure of which is incorporated herein by reference.

BACKGROUND

The present disclosure relates to a coil component and a power supply apparatus including the same.

Generally, a coil component includes a core, a bobbin, a winding, and the like.

In accordance with the miniaturization of coil components, various efforts to secure sufficient insulation between the winding and the core or between a primary coil and a secondary coil have been made.

In addition, in the case of winding coils formed of wire, there may be a problem in which coil turns or winding positions of the coils are not constant, due to human error.

Therefore, a coil component having a novel structure for the miniaturization of coil components and for the simplification of a manufacturing process thereof has been demanded.

RELATED ART DOCUMENT (Patent Document 1) Japanese Patent Publication No. 3427428

SUMMARY

An aspect of the present disclosure may provide a coil component capable of constantly maintaining a coupling coefficient between a primary coil and a secondary coil, and a power supply apparatus including the same.

According to an aspect of the present disclosure, a coil component may include a first coil part including a multilayer substrate on which a conductor pattern is formed, a second coil part formed as a wire and stacked together with the first coil part, a core coupled to the first and second coil parts while penetrating through the first and second coil parts to thereby be electromagnetically coupled to the first and second coil parts, and a pressing member interposed between the core and the second coil part to allow the first and second coil parts to closely adhere to each other.

According to another aspect of the present disclosure, a coil component may include a core, a first coil part including a multilayer substrate on which a conductor pattern is formed and coupled to the core, and a second coil part including at least one fixing coil turn wound around the core and the remaining coil turns wound along the conductor pattern of the first coil part.

A pressing member may be interposed between the fixing coil turn and the remaining coil turns of the second coil part to secure an interval between the fixing coil turn and the remaining coil turns.

According to another aspect of the present disclosure, a power supply apparatus may include a coil component including a first coil part, a second coil part formed as a wire and stacked together with the first coil part, and a pressing member coupled to the second coil part to limit movement of the second coil part, and a main board on which the coil component is mounted.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Figure 1:
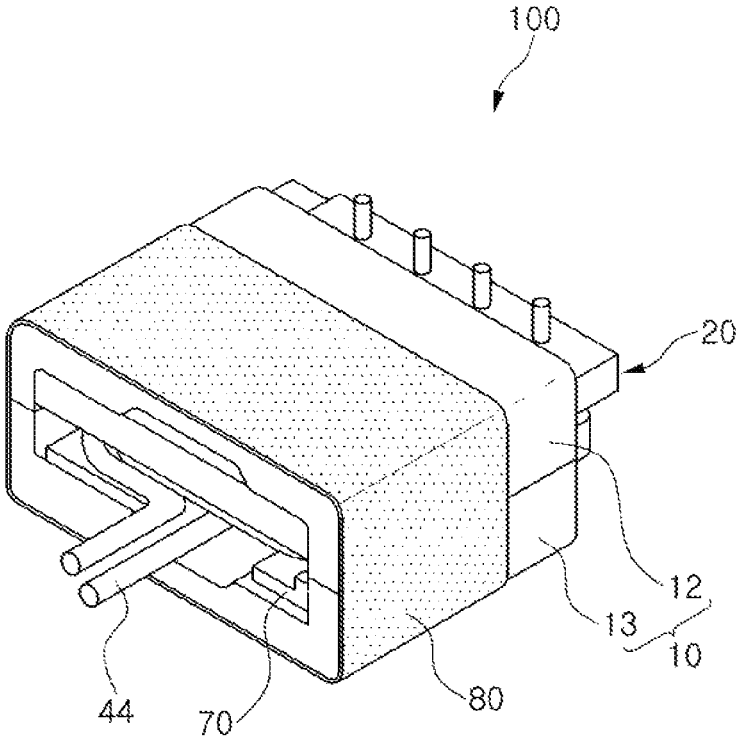
FIG. 1 is a bottom perspective view schematically illustrating a coil component according to an exemplary embodiment in the present disclosure.

Exemplary embodiments of the present disclosure will now be described in detail with reference to the accompanying drawings.

The disclosure may, however, be embodied in many different forms and should not be construed as being limited to the embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

Figure 2:
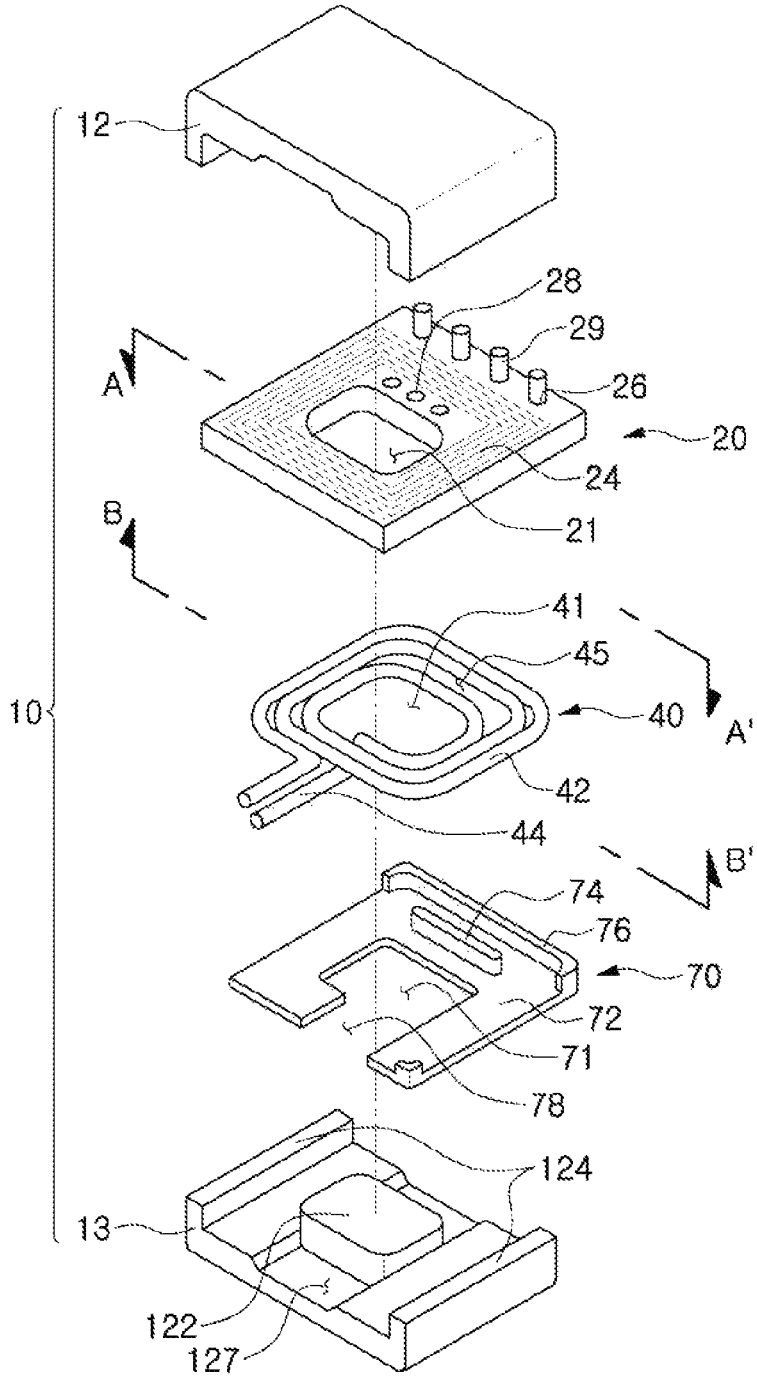
FIG. 2 is a bottom exploded perspective view schematically illustrating the coil component of FIG. 1.

FIG. 1 is a bottom perspective view schematically illustrating a coil component according to an exemplary embodiment in the present disclosure; and FIG. 2 is a bottom exploded perspective view schematically illustrating the coil component of FIG. 1.

Figure 3:
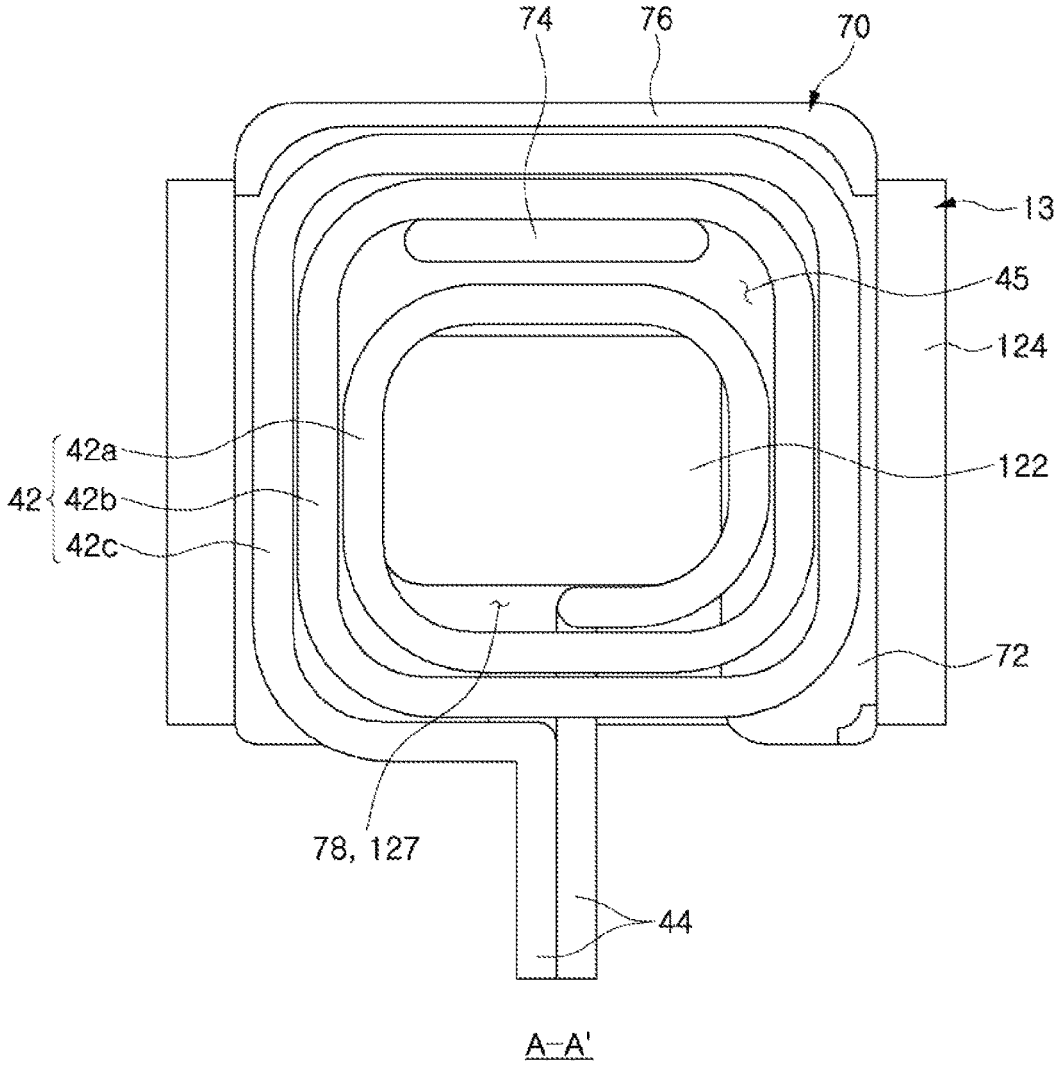
FIG. 3 is a plan view along line A-A of FIG. 2.
Figure 4:
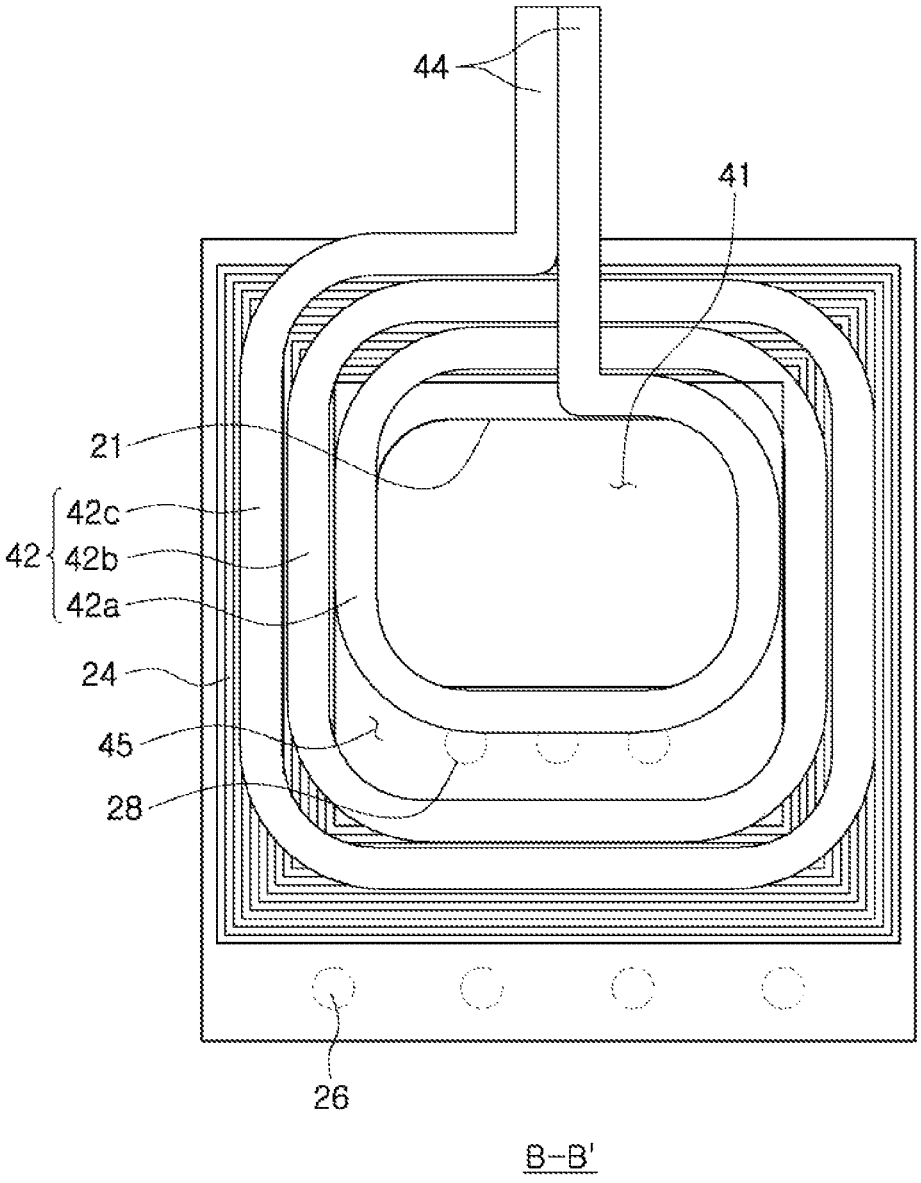
FIG. 4 is a plane view along line B-B of FIG. 2.

In addition, FIG. 3 is a plan view along line A-A of FIG. 2; and FIG. 4 is a plane view along line B-B' of FIG. 2 and shows only first and second coil parts.

Referring to FIGS. 1 through 4, a coil component 100 according to the present exemplary embodiment may include a core 10, a first coil part 20, a second coil part 40, and a pressing member 70.

The core 10 may be an EE shaped core having a middle leg 122 and outer legs 124, and first and second core parts 12 and 13 corresponding to each other may complete the core 10.

Meanwhile, although the EE shaped core of which a cross section has an E shape has been shown in the present exemplary embodiment, the present disclosure is not limited thereto. For example, the core 10 may be formed in various shapes such as an EI shape, a UU shape, a UI shape, and the like.

In addition, the core 10 according to the present exemplary embodiment may have at least one lead groove 127 formed in an inner surface thereof.

The lead groove 127 may be a space in which a lead wire 44 of a second coil part 40 to be described below is disposed in a process in which the lead wire 44 is led to the outside. Therefore, the lead groove 127 may have a width wider and a depth deeper than a diameter of the lead wire 44 of the second coil part 40. However, the present disclosure is not limited thereto.

Since the lead groove 127 is formed, the lead wire 44 of the second coil part 40 may not be excessively closely adhered to a winging part 42. Therefore, a change in a shape of the second coil part 40 due to excessive close adhesion may be significantly decreased, such that a uniform leakage inductance may be obtained. In addition, a resistance generated in a wire itself due to the excessive close adhesion may be decreased.

Here, the lead groove 127 may be formed in the second core part 13 disposed adjacently to the second coil part 40, but is not limited thereto.

In addition, the lead groove 127 may be formed at a size enough for the lead wire 44 disposed therein to move.

The first coil part 20 may be formed of a multilayer substrate in which at least one pattern layer including a conductor pattern 24 is stacked. Here, the conductor pattern 24 may be formed in a spiral shape and be an inductor pattern having a predetermined coil turn.

In addition, an insulating layer may be interposed between the pattern layers. For example, a printed circuit board (PCB) may be used as the multilayer substrate according to the present exemplary embodiment. However, the present disclosure is not limited thereto, but may be variously applied. That is, any substrate including the conductor pattern 24 formed on the insulating layer, such as a flexible substrate, a ceramic substrate, a glass substrate, or the like, may be used as the multilayer substrate.

In addition, in the case in which the pattern layer is implemented by a plurality of layers, conductive vias 28 for electrically connecting the plurality of pattern layers to each other may be formed in the multilayer substrate. However, the present disclosure is not limited thereto, but may be variously applied. For example, the pattern layers may be connected to each other through a side surface of the multilayer substrate.

The first coil part 20 may have a through-hole 21 formed in the multilayer substrate. A middle leg 122 of a core 10 to be described below may be inserted into the through-hole 21. Therefore, the through-hole 21 may be formed in a shape corresponding to that of a cross section of the middle leg 122 of the core 10.

In addition, the first coil part 20 may include a terminal pad 26 to which terminal pins 29 are fastened and the conductive vias 28. The terminal pad 26 and the conductive vias 28 may be electrically connected to the conductor pattern 24.

The terminal pads 26 may be disposed at an outer side portion of the multilayer substrate. A plurality of terminal pads 26 may be formed and be disposed in a line at one side of the multilayer substrate.

The terminal pins 29 may be fastened to the terminal pad 26. The terminal pins 29 may be provided in order to electrically connect the first coil part 20 and a main board 1 (See FIG. 5) to each other.

The conductive vias 28 may electrically connect the conductor patterns 24 disposed on different layers to each other. Therefore, a coil pattern of the first coil part 20 may be completed by the conductor patterns 24 and the conductive vias 28.

The conductive vias 28 according to the present exemplary embodiment 28 may be disposed in a spiral internal space formed by the conductor patterns 24. Therefore, the conductor pattern 24 may be electrically connected to the conductive vias 28 in the spiral internal space to thereby be electrically connected to conductor patterns 24 on other layers.

In addition, since the conductive vias 28 are formed in the spiral internal space, the conductor patterns 24 may be partially spaced apart from the through-hole 21. Here, a distance between the conductor pattern 24 and the through-hole 21 spaced apart from each other may be set depending on a size of the conductive via 28, or the like.

Therefore, the through-hole 21 may be disposed in the spiral internal space formed by the conductor patterns 24 and be disposed in a form in which it is biased toward one side in the spiral internal space. In addition, the conductive vias 28 may be disposed between the through-hole 21 and the conductor patterns 24.

The first coil part 20 according to the present exemplary embodiment configured as described above may be used as a primary coil. Therefore, the second coil part 40 may be used as a secondary coil. However, the present disclosure is not limited thereto, but may be variously modified. For example, a second coil part 40 to be described below may be used as the primary coil.

The second coil part 40 may include a conductor wire having an insulating coating.

The second coil part 40 may be stacked together with the first coil part 20 while securing insulation with the conductor patterns 24 of the first coil part 20. Here, the insulation may be secured by the insulating coating.

For example, the second coil part 40 according to the present exemplary embodiment may be a triple insulating wire in which three insulating coatings are formed so as to protect the conductor wire. However, the present disclosure is not limited thereto. That is, the second coil part 40 may also be formed of a general insulating wire or a rectangular wire. In this case, at least one insulating sheet may be interposed between the second coil part 40 and the first coil part 20.

The second coil part 40 may include a part 42 (hereinafter, referred to as a winding part) in which a wire is wound in a spiral shape and the lead wire 44 led from both ends of the second coil part 40 to the outside of the winding part 42.

The winding part 42 may be wound around the middle leg 142 of the core. Therefore, the winding part may be wound in a spiral shape in which a diameter thereof is increased toward an outer diameter of the middle leg after a first coil turn thereof is wound along an outer peripheral surface of the middle leg.

The winding part 42 may be formed in a shape corresponding to that of the conductor pattern 24 of the first coil part 20 described above.

That is, when the first and second coil parts 20 and 40 are coupled to each other, the conductor pattern 24 of the first coil part 20 and the winding part 42 of the second coil part 40 may be disposed so as to have the concentricity and be disposed so as to form contours corresponding or similar to each other.

For example, in the case in which the conductor pattern 24 of the first coil part 20 is a rectangular coil pattern as shown in FIG. 4, the winding part 42 of the second coil part 40 may be formed in a rectangular spiral shape corresponding to that of the conductor pattern 24. Likewise, although not shown, in the case in which the conductor pattern 24 of the first coil part 20 is a circular coil pattern, the winding part 42 of the second coil part 40 may also be formed in a circular shape corresponding to that of the conductor pattern 24.

In the case in which the first and second coil parts 20 and 40 are formed in similar shapes as described above and are coupled to each other so as to be overlapped with each other, a coupling coefficient between the first and second coil parts 20 and 40 may be increased, such that a leakage inductance may be significantly decreased.

In addition, the winding part 42 according to the present exemplary embodiment may have at least one spacing part 45 formed between wound wires. For example, the spacing part 45 may mean a space between any one (for example, an N-th coil turn) of wire coil turns configuring the winding part 42 and the next coil turn (for example, an N+1-th coil turn) subsequently to the N-th coil turn.

Here, the N-th coil turn may be a first coil turn formed at the innermost side of the winding part 42, and the N+1-th coil turn may be a second coil turn. For example, in the second coil part 40 according to the present exemplary embodiment, the spacing part 45 may be formed between the first coil turn disposed at the innermost side and remaining coil turns.

The spacing part 45 may be derived in order to fix movement of the second coil part 40 formed as a wire and allow a shape of the winding part 42 to correspond to that of the conductor pattern 24 of the first coil part 20, as described above.

A more detailed description thereof will be provided below.

As described above, in the first coil part 20 according to the present exemplary embodiment, the conductor pattern 24 may not be formed depending on a shape of the through-hole 21, and the through-hole 21 may be formed in an inner portion formed by the conductor pattern 24 in a state in which it is biased toward one side by the conductive vias 28.

In addition, the second coil part 40 may be formed in a shape corresponding to that of the conductor pattern 24 of the first coil part 20 in order to increase a coupling coefficient with the first coil part 20.

However, in this case, it may be difficult to fix the second coil part 40 to a regular position. On the other hand, in the case in which the second coil part 40 is sequentially wound around the middle leg 122 of the core 10, the second coil part 40 may be fixed, while it may be difficult to form the second coil part 40 in the shape corresponding to that of the conductor pattern 24 of the first coil part 20.

Therefore, in the second coil part 40 according to the present exemplary embodiment, as shown in FIGS. 3 and 4, at least one coil turn 42*a* (fixing coil turn) may be wound around the middle leg 122 of the core 10, and the remaining coil turns 42*b* and 42*c* may be wound in the shape corresponding to that of the conductor pattern 24 of the first coil part 20.

Therefore, since the second coil part 40 may be fixed to the middle leg 122 of the core 10 by the fixing coil turn 42*a* and shapes of the remaining coil turns 42*a* and 42*c* correspond to that of the conductor pattern 24 of the first coil part 20, the coupling coefficient between the second coil part 40 and the first coil part 20 may be increased.

Due to the above-mentioned configuration, the spacing part 45 may be formed between the fixing coil turn 42*a* wound around the middle leg 122 and the remaining coil turns 42*b* and 42*c*. Here, an interval of the spacing part 45 may correspond to a distance by which the through-hole 21 and the conductor pattern 24 are spaced apart from each other by the conductive vias 28 in the first coil part 20.

In addition, an insertion protrusion 74 of a pressing member 70 to be described below may be inserted into the spacing part 45.

The lead wire 44 may mean a part extended from both ends of the winding part 42 and then led to the outside of the winding part 42. Here, the lead wire 44 led from an inner side of the winding part 42 may be led to the outside of the winding part 42 while traversing the winding part 42. Therefore, the lead wire 44 may be led while traversing the wire of the winding part 42.

The pressing member 70 may be disposed between an inner surface of the core 10 and the second coil part 40 to fix a shape of the second coil part 40 and secure insulation between the second coil part 40 and the core 10.

Referring to FIG. 2, the pressing member 70 may include a pressing plate 72 formed in a flat plate shape, the insertion protrusion 74 protruding from one surface of the pressing plate 72, and a support protrusion 76.

The pressing plate 72 may be generally formed depending on the shape of the second coil part 40, and may have a hollow part 71 formed therein so that the middle leg 122 of the core 10 is inserted thereinto and a skip groove 78 formed at one side thereof so that the lead wire 44 of the first coil part 20 is led therethrough.

Since the hollow part 71 is a hole into which the middle leg 122 of the core 10 is inserted, it may be formed in the same shape as that of the through-hole 21 of the first coil part 20.

The skip groove 78 may be formed in a form in which it connects the outside and the hollow part 71 to each other by cutting away a portion of the pressing plate 71 to form a groove. The skip groove 78 may be provided in order to lead the lead wire 44 disposed at an inner side of the first coil part 20 to the outside. Therefore, the skip groove 78 may have a width larger than a diameter of the lead wire 44 of the first coil part 20.

The support protrusion 76 may protrude along an edge of one side of the pressing plate 72 and may be provided in order to prevent the second coil part 40 from being excessively exposed to the outside or being deformed and maintain the shape of the second coil part 40.

Therefore, the support protrusion 76 may protrude by a distance corresponding to or smaller than a diameter of the wire of the second coil part 40. In addition, an inner surface of the support protrusion 76 may be formed in a shape corresponding to that of an outer circumference of the winding part 42 of the second coil part 40.

The second coil part 40 according to the present exemplary embodiment may be wound in a rectangular shape of which corners are rounded. Therefore, the inner surface of the support protrusion 76 may be formed in a shape in which it may support the rectangular shape of which the corners are rounded.

The insertion protrusion 74 may be inserted into the spacing part 45 of the first coil part 20, as described above. Therefore, a length and a width of the insertion protrusion 74 may correspond to or be smaller than those of the spacing part 45.

The case in which one support protrusion 76 and one insertion protrusion 74 are formed has been described by way of example in the present exemplary embodiment. However, the present disclosure is not limited thereto. That is, a plurality of support protrusions 76 and a plurality of insertion protrusions 74 may also be formed.

The pressing member 70 may be formed of an insulating material such as a resin. However, the present disclosure is not limited thereto. That is, the pressing member 70 may also be configured so as to have a function of a shielding member decreasing an electromagnetic interference (EMI) by burying a conductive plate therein or mixing conductive powders with the insulating material.

In addition, the pressing member 70 may serve to allow the first and second coil parts 20 and 40 to closely adhere to each other. Therefore, since an interval between the conductor pattern 24 of the first coil part 20 and the conductor wire of the second coil part 40 may be constantly maintained in the core 10, the coil component 100 in which a deviation of a leakage inductance that may be generated between conductors is significantly decreased may be manufactured.

Meanwhile, the coil component 100 according to the present exemplary embodiment may include an insulating member 80 (See FIG. 1) disposed on an outer portion of the core in order to firmly couple the core. The insulating member 80 may be formed of an insulating tape or an insulating rubber, but is not limited thereto.

The coil component 100 according to the present exemplary embodiment configured as described above may be manufactured by stacking the second coil part 40 on the first coil part 20, stacking the pressing member 70 on the second coil part 40, and then coupling the core 10 thereto at both sides.

Therefore, the coil component 100 may be very easily manufactured. In addition, the second coil part 40 formed of the wire may be always disposed at the regular position, may maintain its shape, and may be closely adhered and coupled to the first coil part 20, by the pressing member 70. Therefore, since the first and second coil parts 20 and 40 are always coupled to each other at the same position, the coupling coefficient between the first and second coil parts 20 and 40 may be increased, such that the leakage inductance may be significantly decreased.

In addition, a bobbin according to the related art, a process of winding the coil around the bobbin, and the like, may be omitted, such that the coil component may be easily manufactured and a cost required for manufacturing the coil component may be decreased.

Figure 5:
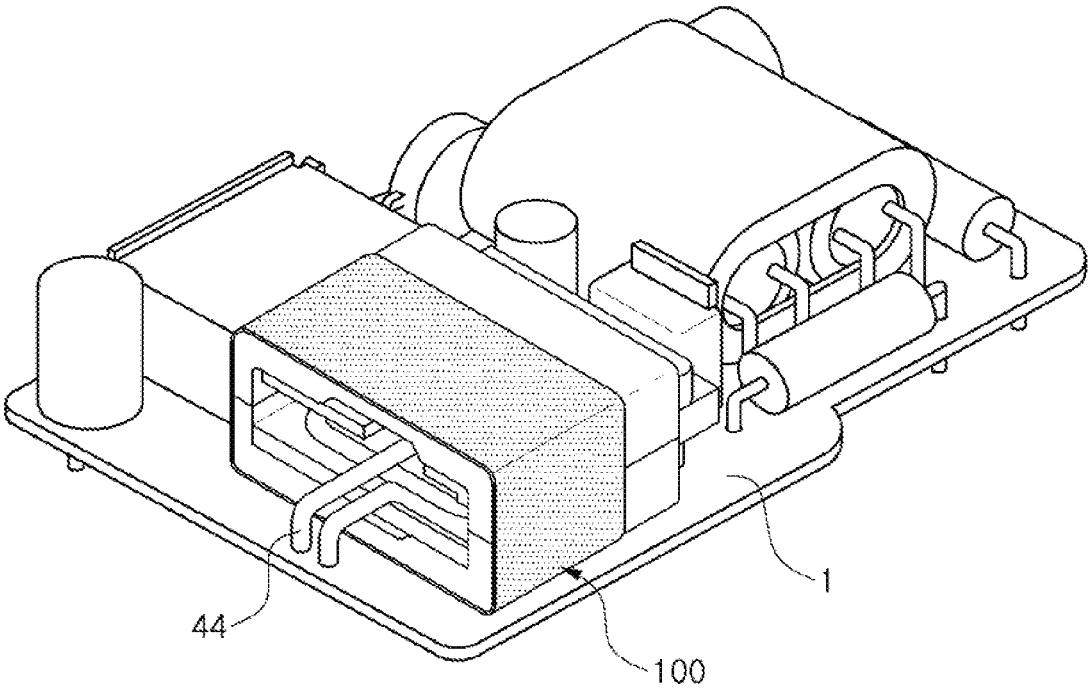
FIG. 5 is a perspective view schematically illustrating a state in which the coil component according to an exemplary embodiment in the present disclosure is mounted on a main board.

FIG. 5 is a perspective view schematically illustrating a state in which the coil component according to an exemplary embodiment in the present disclosure is mounted on a main board.

Referring to FIG. 5, the coil component 100 according to the present exemplary embodiment may be mounted on a main board 1 to complete a power supply apparatus.

Here, the first coil part of the coil component 100 may be electrically connected to the main board 1 through a terminal pin (not shown), and the second coil part thereof may have the lead wire 44 directly bonded to the main board 1 to thereby be electrically connected to the main board 1.

In this case, various modifications may be made. For example, the lead wire 44 of the second coil part may be lengthily extended to thereby be bonded to the main board at a long distance rather than the periphery of the coil component 100.

Figure 6:
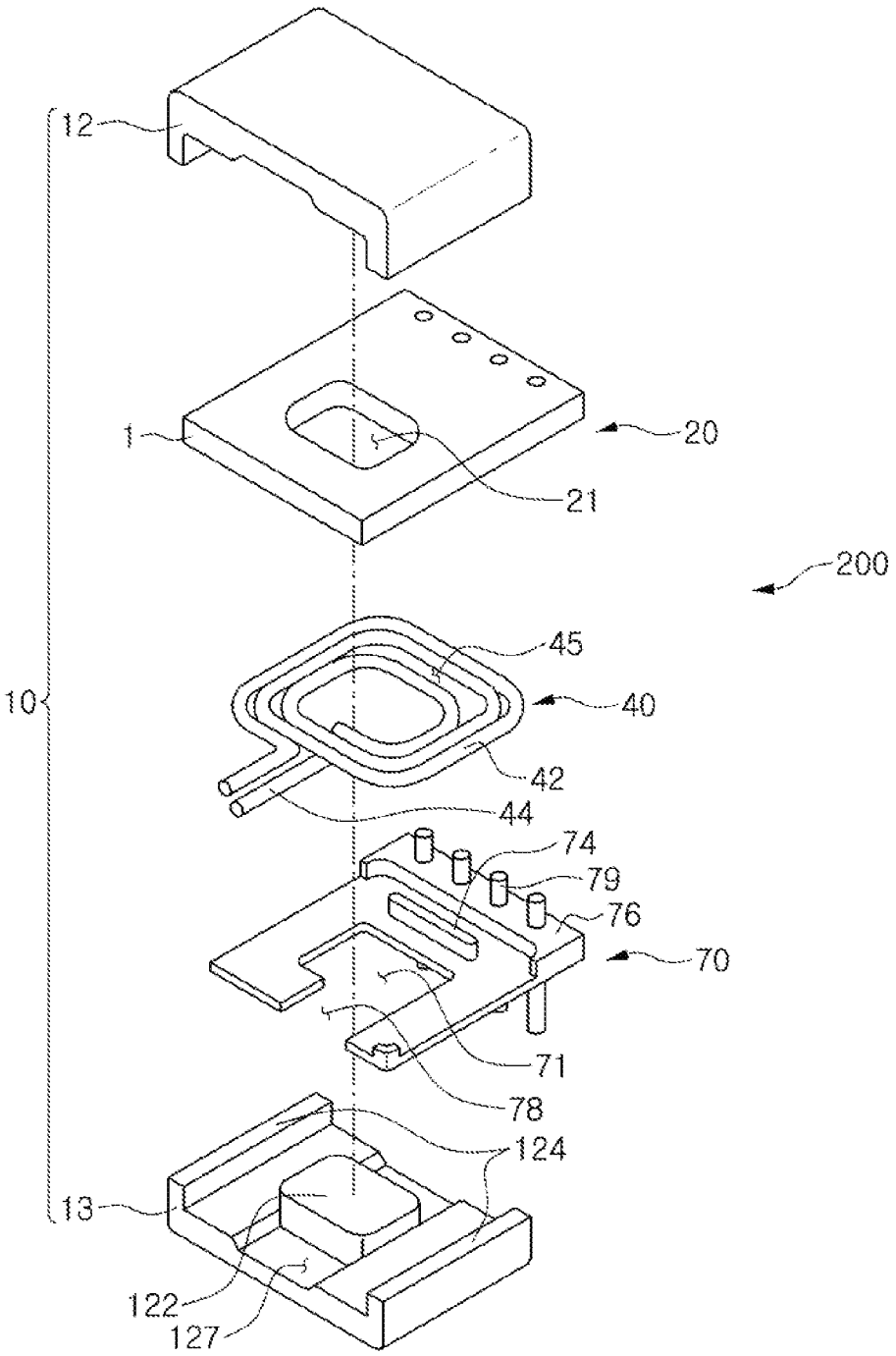
FIG. 6 is an exploded perspective view schematically illustrating a coil component according to another exemplary embodiment in the present disclosure.

FIG. 6 is an exploded perspective view schematically illustrating a coil component according to another exemplary embodiment in the present disclosure.

Referring to FIG. 6, in the coil component 200 according to the present exemplary embodiment, the first coil part 20 may be disposed on the second coil part 40 as opposed to the above-mentioned exemplary embodiment.

In addition, a plurality of terminal pins 79 may be fastened to the support protrusion 76 of the pressing member 70, and the first coil part 20 may be bonded to the terminal pins 79 of the pressing member 70 to thereby be electrically connected to a main board (not shown) through the terminal pins 79.

As described above, the coil component according to the present exemplary embodiment may be variously modified, if necessary.

As set forth above, with the coil component and the power supply apparatus according to exemplary embodiments of the present disclosure, the second coil part formed of the wire may be always disposed at the regular position and may maintain its shape, by the pressing member. Therefore, since the first and second coil parts are always coupled to each other at the same position, the coupling coefficient between the first and second coil parts may be increased, such that the leakage inductance may be significantly decreased.

In addition, a bobbin according to the related art, a process of winding the coil around the bobbin, and the like, may be omitted, such that the coil component may be easily manufactured and a cost required for manufacturing the coil component may be decreased.

While exemplary embodiments have been shown and described above, it will be apparent to those skilled in the art that modifications and variations could be made without departing from the scope of the present invention as defined by the appended claims.

What is claimed is:

1. A coil component comprising:

a first coil part comprising a multilayer substrate on which a conductor pattern is formed;

a second coil part formed as a wire and stacked with the first coil part;

a core coupled to the first and second coil parts while penetrating through the first and second coil parts to be electromagnetically coupled to the first and second coil parts; and a pressing member interposed between the core and the second coil part to allow the first and second coil parts to adhere to each other, wherein the second coil part comprises a winding part in which the wire is wound in a spiral shape, and wherein the pressing member comprises a pressing plate configured to press the second coil part toward the first coil part to allow the first coil part and the second coil part to closely adhere to each other; and wherein the pressing member comprises a support protrusion protruding along an edge of one side of the pressing plate and protruding corresponding to or smaller than a diameter of the wire of the second coil part.

2. The coil component of claim 1, wherein the winding part is formed in a shape corresponding to that of the conductor pattern of the first coil part for increasing a coupling coefficient between the first and second coil parts.

3. The coil component of claim 1, wherein the pressing member maintains a shape of the second coil part while limiting movement of the second coil part.

4. The coil component of claim 1, wherein the pressing member comprises a pressing plate formed in a plate shape to correspond to a shape of the second coil part.

5. The coil component of claim 1, wherein the pressing member comprises a hollow part for inserting a middle leg of the core.

6. The coil component of claim 1, wherein the core comprises at least one lead groove formed in an inner space of the core.

7. The coil component of claim 6, wherein the lead groove is a space in which a lead wire of the second coil part is disposed and is led to an outside.

8. The coil component of claim 1, wherein the second coil part insulates with the conductor pattern of the first coil part by the insulating coating.

* * * * *